US006667718B2

(12) United States Patent
Back et al.

(10) Patent No.: US 6,667,718 B2
(45) Date of Patent: Dec. 23, 2003

(54) MICROSTRIP DUAL BAND ANTENNA

(75) Inventors: Seok Hyun Back, Incheon-shi (KR); Jin Myeong Kim, Seoul (KR); Byeong Gook Kim, Daejeon-shi (KR); Dae Hyeon Jeong, Seoul (KR); Yeong Jo Kang, Kyunggi-do (KR); Hyeok Joo Kwon, Kangseo-gu (KR)

(73) Assignee: Kosan I & T Co., Ltd., Seoul (KR)

( * ) Notice: Subject to any disclaimer, the term of this patent is extended or adjusted under 35 U.S.C. 154(b) by 0 days.

(21) Appl. No.: 10/199,242

(22) Filed: Jul. 18, 2002

(65) Prior Publication Data

US 2003/0214442 A1 Nov. 20, 2003

(30) Foreign Application Priority Data

May 15, 2002 (KR) ..... 10-2002-0026839

(51) Int. Cl.[7] ..... H01Q 1/38
(52) U.S. Cl. ..... 343/700 MS; 343/846
(58) Field of Search ..... 343/700 MS, 702, 343/846

(56) References Cited

U.S. PATENT DOCUMENTS 6,421,014 B1 * 7/2002 Sanad ..... 343/700 MS

* cited by examiner

*Primary Examiner*—Hoang Nguyen
(74) *Attorney, Agent, or Firm*—Snell & Wilmer, L.L.P.

(57) ABSTRACT

Disclosed is a microstrip dual band antenna. The microstrip dual band antenna comprises a feeder hole defined in a widthwise middle portion adjacent to one end of a dielectric body which is formed in the shape of a quadrangular prism, a radiation patch line formed on an upper surface and on a portion of a lower surface of the dielectric body, such that it is placed around the feeder hole, extends through a first predetermined distance toward the other end of the dielectric body while having a first width corresponding to a diameter of the feeder hole, and extends through a second predetermined distance while surrounding the other end of the dielectric body and having a second width corresponding to a width of the dielectric body, a ground line formed on the lower surface of the dielectric body to be separated from the radiation patch line, such that it extends toward one end of the dielectric body while having the second width corresponding to the width of the dielectric body; a pair of strip lines formed on the lower surface of the dielectric body such that each of them substantially defines an L-shaped configuration and extends from a position separated from the feeder hole toward the other end of the dielectric body, and a pair of connection holes defined in the dielectric body at both sides of the feeder hole, respectively, and plated with suitable material.

2 Claims, 7 Drawing Sheets

Marker 1: 2.40000 GHz

Marker 2: 2.48350 GHz

Marker 3: 5.15000 GHz

Marker 4: 5.82500 GHz

Marker 1: 1:1.7793
2.40000 GHz
Marker 2: 1:1.6923
2.48350 GHz
Marker 3: 1:1.7623
5.15000 GHz
Marker 4: 1:1.3860
5.82500 GHz Marker 1: 36.215Ω
2.40000 GHz
Marker 2: 39.107Ω
2.48350 GHz
Marker 3: 55.316Ω
5.15000 GHz
Marker 4: 37.037Ω
5.82500 GHz Azimuth Pattern.

MICROSTRIP DUAL BAND ANTENNA

The application claims priority of Korean Patent Application Serial No. 10-2002-0026839 filed on May 15, 2002.

1. Field of Invention

The present invention relates to a microstrip dual band antenna, and more particularly, the present invention relates to a microstrip dual band antenna which can achieve in the industrial, scientific and medical (ISM) band a return loss and a voltage standing wave ratio (VSWR) appropriate to a communication terminal, accomplish a satisfactory radiation pattern, be minimized in its size, and be installed on various radio communication equipment in a miniaturized state.

2. Background of the Invention

These days, with miniaturization of portable mobile communication terminals, internal mounting type antennas have been disclosed in the art. Further, as various communication services are rendered, in order to ensure high communication quality, microchip antennas, which are small-sized, lightweight and capable of overcoming disadvantages of external mounting type antennas, have been developed. Among the microchip antennas, a dual band antenna is highlighted since it can satisfy several kinds of services in an integrated manner.

However, in the conventional art, a drawback exists in that the microchip antenna cannot properly solve problems associated with miniaturization and design of a communication terminal, and it is inherently difficult to expand a bandwidth in the dual band antenna. In particular, since most of the conventional antennas are externally mounted to the communication terminal, impedance matching circuits are employed, and therefore, the number of processes and a manufacturing cost are increased.

SUMMARY OF THE INVENTION

Accordingly, the present invention has been made in an effort to solve the problems occurring in the related art, and an object of the present invention is to provide a microstrip dual band antenna which can achieve in the ISM band a return loss and a VSWR appropriate to a communication terminal, and accomplish a satisfactory radiation pattern, in a manner such that it can be installed on various radio communication equipment in a miniaturized state.

In order to achieve the above object, according to the present invention, there is provided a microstrip dual band antenna comprising: a feeder hole defined in a widthwise middle portion adjacent to one end of a dielectric body which is formed in the shape of a quadrangular prism; a radiation patch line formed on an upper surface and on a portion of a lower surface of the dielectric body, in a manner such that it is placed around the feeder hole, extends through a first predetermined distance toward the other end of the dielectric body while having a first width corresponding to a diameter of the feeder hole, and extends through a second predetermined distance while surrounding the other end of the dielectric body and having a second width corresponding to a width of the dielectric body; a ground line formed on the lower surface of the dielectric body to be separated from the radiation patch line, in a manner such that it extends toward one end of the dielectric body while having the second width corresponding to the width of the dielectric body; a pair of strip lines formed on the lower surface of the dielectric body in a manner such that each of them substantially defines an L-shaped configuration and extends from a position separated from the feeder hole toward the other end of the dielectric body; and a pair of connection holes defined in the dielectric body at both sides of the feeder hole, respectively, and plated with suitable material.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION

Figure 1:
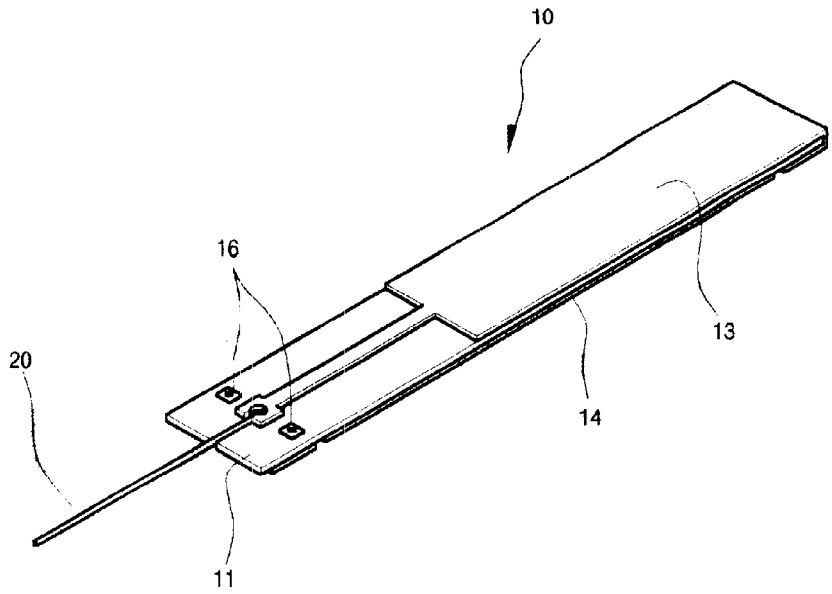
FIG. 1 is a perspective view illustrating a microstrip dual band antenna according to the present invention, which includes a feeder cable.

Reference will now be made in greater detail to a preferred embodiment of the invention, an example of which is illustrated in the accompanying drawings. Wherever possible, the same reference numerals will be used throughout the drawings and the description to refer to the same or like parts.

With the development of a radio communication technology, external and internal radio communication networks have been widely spread throughout the world. In order to ensure efficient utilization of limited radio wave resources while not undergoing radio interference, legislation has been internationally and domestically enacted. Accordingly, frequency bands for which radio stations can be established without separate governmental permission so long as technical conditions in terms of frequency, output, etc. correspond to settings by the government, have drawn considerable attention. Among these frequency bands, the ISM band is used for industrial, scientific and medical purposes.

The ISM band was internationally prescribed by the international telecommunication union (ITU). In the ISM band, ten frequency ranges were assigned for Korea, including 6.765~6.795 MHz, 13.553~13.567 MHz, 26.957~27.283 MHz, 40.66~40.70 MHz, 2.40~2.50 GHz, 5.725~5.875 GHz, 24.00~24.25 GHz, 61.00~61.50 GHz, 122.00~123.00 GHz and 244.00~246.00 GHz.

ISM equipment operated in these frequency ranges is designed in a manner such that it produces and uses radio frequency (RF) energy with industrial (exclusive of electronics and communication industries), scientific, medical or similar purposes.

From the 1990s, in North America centering around the Unites States, radio communication terminals, which adopt a spread spectrum method not exerting radio interference upon other radio facilities, can be operated, without obtaining separate permission, using some of frequency ranges included in the ISM band. Thus, the radio communication terminals can be employed for a radiotelephone, a Bluetooth-enabled device, a wireless LAN, etc. Also, in Korea, concern over the use of the ISM band has gradually increased among telecommunication carriers, manufacturers, etc.

The present invention is related to a microstrip dual band antenna 10 which can be reliably used in the ISM band. Detailed description thereof will be given hereafter.

Figure 2:
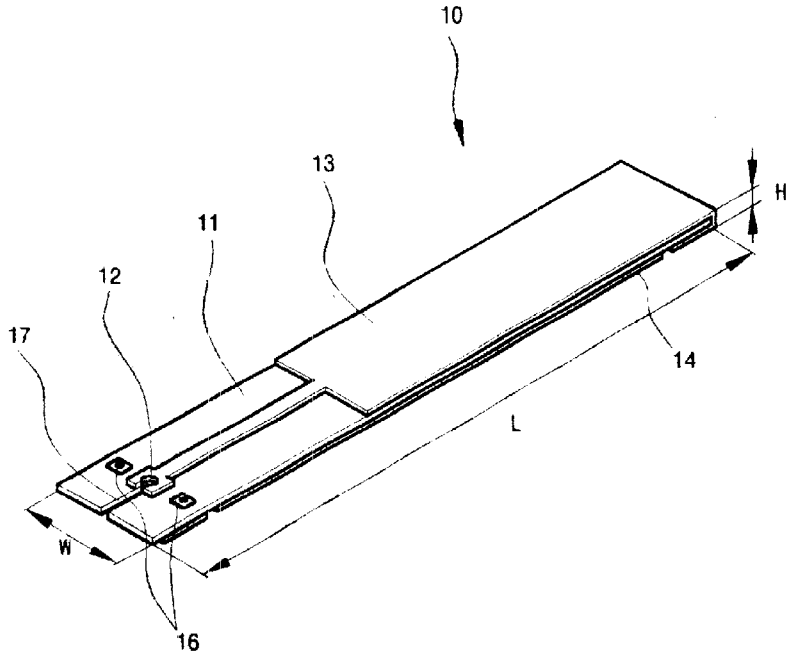
FIG. 2 is a perspective view independently illustrating the microstrip dual band antenna according to the present invention.
Figure 3:
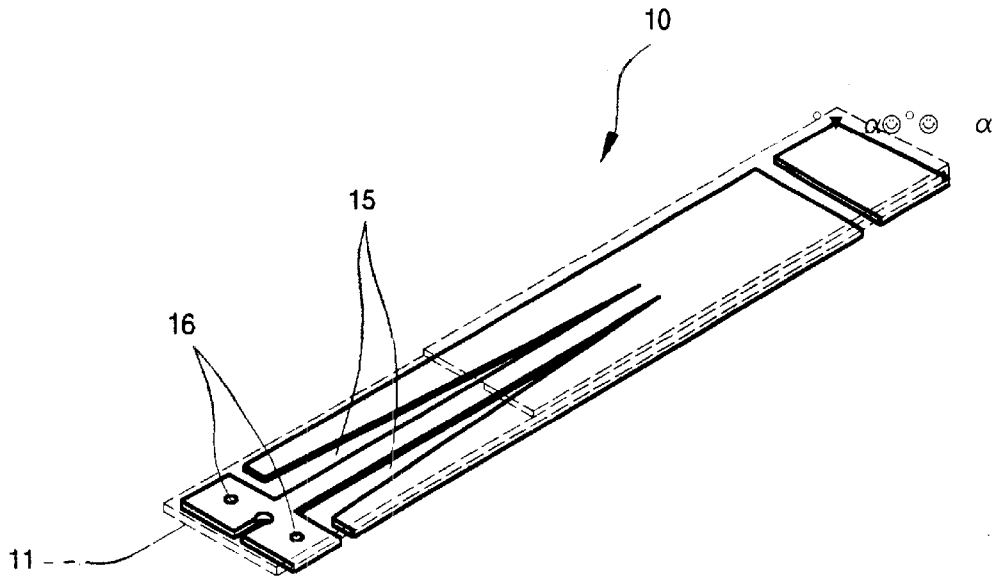
FIG. 3 is a perspective view illustrating a lower part of the microstrip dual band antenna according to the present invention.

FIG. 1 is a perspective view illustrating a microstrip dual band antenna 10 according to the present invention, which includes a feeder cable 20. The microstrip dual band antenna 10 comprises a dielectric body 11 which is formed in the shape of a quadrangular prism. A radiation patch line 13 is substantially formed on an upper surface of the dielectric body 11, and a ground line 14 is formed on a lower surface of the dielectric body 11. FIG. 2 is a perspective view independently illustrating the microstrip dual band antenna 10 according to the present invention. In this preferred embodiment, the dielectric body 11 has a length L of 48.5 mm, a width W of 8 mm and a height H of 1 mm. FIG. 3 is a perspective view illustrating a lower part of the microstrip dual band antenna 10 according to the present invention. By omitting or contouring the dielectric body 11 using a dashed line, an appearance of the lower part can be confirmed.

Figure 4:
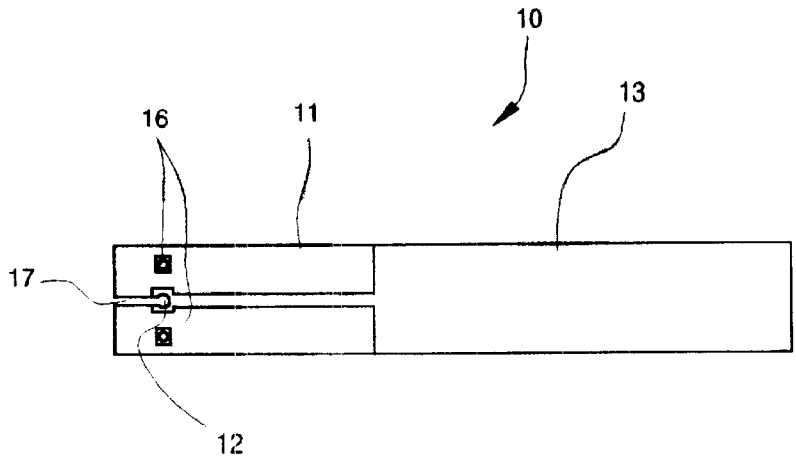
FIG. 4 is a plan view illustrating the microstrip dual band antenna according to the present invention.
Figure 5:
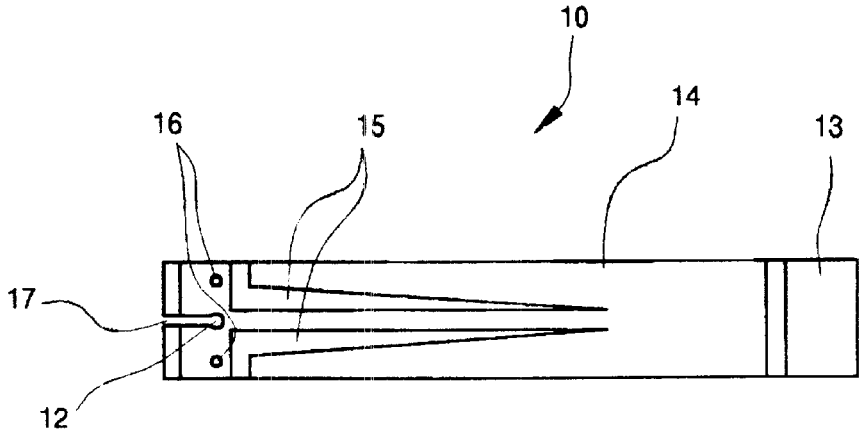
FIG. 5 is a bottom view illustrating the microstrip dual band antenna according to the present invention.

FIG. 4 is a plan view illustrating the microstrip dual band antenna 10 according to the present invention, clearly illustrating the radiation patch line 13, and FIG. 5 is a bottom view illustrating the microstrip dual band antenna 10 according to the present invention, clearly illustrating the ground line 14.

As shown in FIGS. 1 through 5, the microstrip dual band antenna 10 according to the present invention comprises the dielectric body 11 made of epoxy. As described above, the radiation patch line 13 is substantially formed on the upper surface of the dielectric body 11, and the ground line 14 is formed on the lower surface of the dielectric body 11.

As described above, in this preferred embodiment of the present invention, the dielectric body 11 which is formed in the shape of a quadrangular prism has a length L of 48.5 mm, a width W of 8 mm and a height H of 1 mm. A feeder hole 12 is defined in a widthwise middle portion adjacent to one end of the dielectric body 11.

Concretely speaking, the radiation patch line 13 is formed on the upper surface and on a portion of the lower surface of the dielectric body 11, in a manner such that it is placed around the feeder hole 12, extends through a first predetermined distance toward the other end of the dielectric body 11 while having a first width corresponding to a diameter of the feeder hole 12, and extends through a second predetermined distance while surrounding the other end of the dielectric body 11 and having a second width corresponding to the width W of the dielectric body 11.

The ground line 14 is formed on the lower surface of the dielectric body 11 to be separated from the radiation patch line 13, in a manner such that it extends toward one end of the dielectric body 11 while having the second width corresponding to the width W of the dielectric body 1. A pair of strip lines 15 are formed on the lower surface of the dielectric body 11 in a manner such that each of them substantially defines an L-shaped configuration and extends from a position separated from the feeder hole 12 toward the other end of the dielectric body 11.

Further, a pair of connection holes 16 are defined in the dielectric body 11 at both sides of the feeder hole 12, respectively, and plated with suitable material.

Meanwhile, in the microstrip dual band antenna 10 according to the present invention, in consideration of limitation in a size of a printed circuit board (not shown) used in the ISM band, a cable passage 17 is defined in the dielectric body 11 to extend from the feeder hole 12 to one end of the dielectric body 11, so that the feeder cable 20 can be easily received in the cable passage 17 and connected to the feeder hole 12.

Due to the above-described construction, since characteristics of 2 GHz and 5 GHz bands can be obtained, the microstrip dual band antenna 10 according to the present invention can reliably operate in the ISM band. Hereafter, the characteristics of the microstrip dual band antenna 10 according to the present invention will be described in detail with reference to FIGS. 6 through 9.

In the conventional art, since the microstrip stacked antenna belongs, in its inherent characteristic, to a resonance antenna, disadvantages are caused in that a frequency bandwidth is considerably decreased to several percents and a radiation gain is low. Due to this low radiation gain, because a plurality of patches must be arrayed or stacked one upon another, a size and a thickness of the antenna cannot but be increased.

However, in the present invention, the microstrip dual band antenna 10 has a wide frequency bandwidth and a decreased leakage current, whereby a high gain is obtained. In particular, as a VSWR is improved and a size of the antenna is decreased, miniaturization of various radio communication equipment is made possible.

Figure 6:
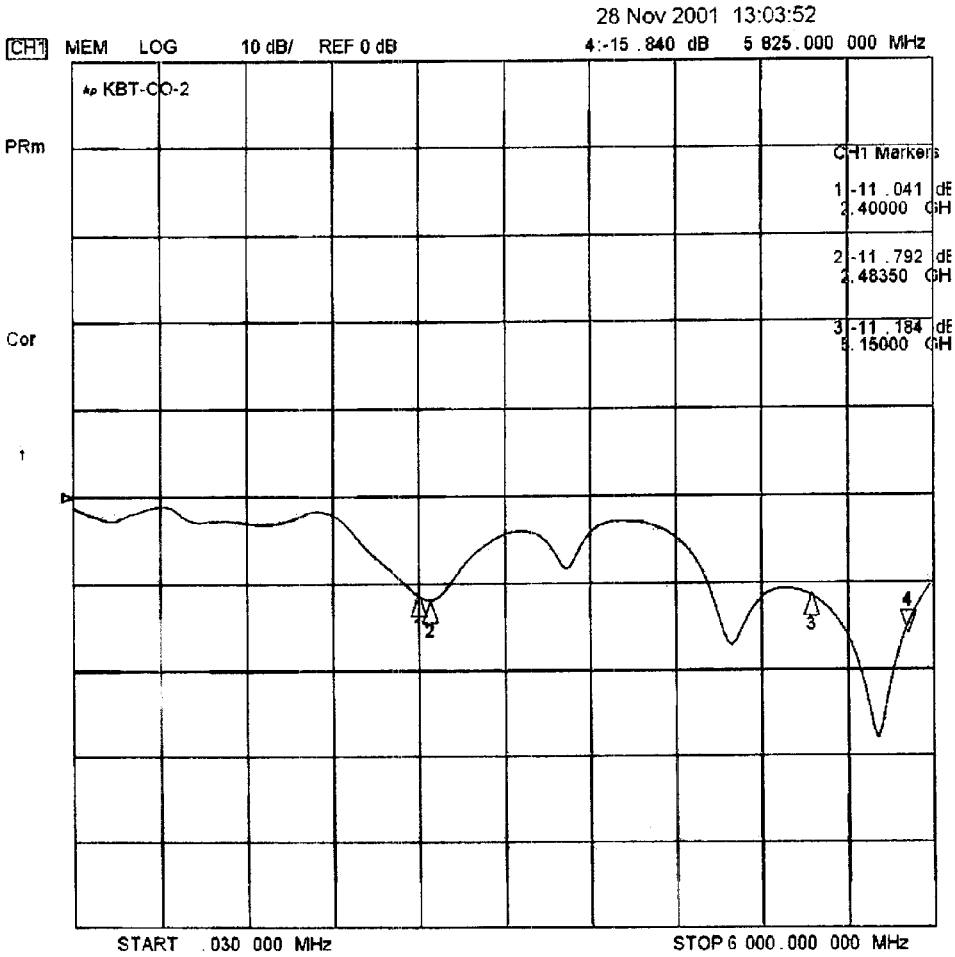
FIG. 6 is a graph illustrating a relationship between a frequency and a return loss in the microstrip dual band antenna according to the present invention.

FIG. 6 is a graph illustrating a relationship between a frequency and a return loss in the microstrip dual band antenna 10 according to the present invention.

As shown in FIG. 6, a service band of the microstrip dual band antenna 10 according to the present invention is realized as a dual band for the ISM, including 2.40000~2.48350 GHz (see Marker 1~Marker 2) and 5.15000~5.82500 GHz (see Marker 3~Marker 4).

Figure 7:
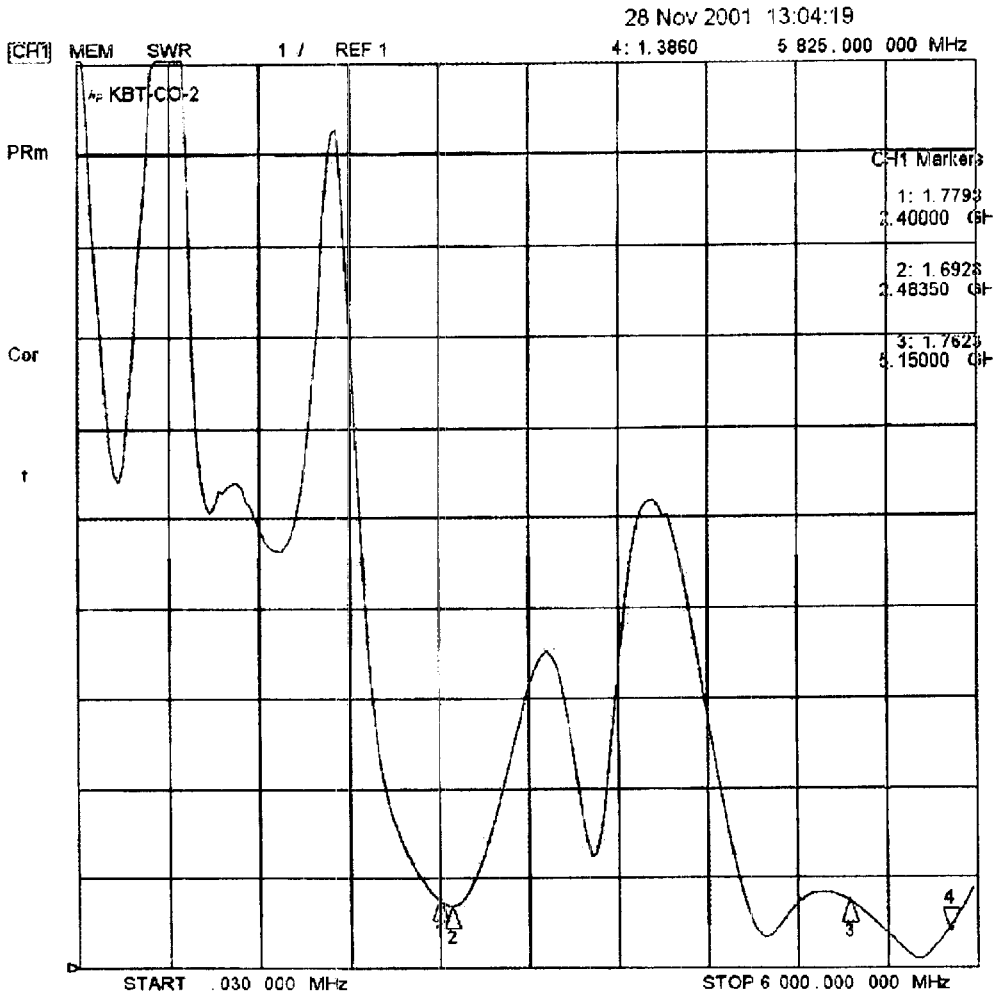
FIG. 7 is a graph illustrating a relationship between a frequency and a voltage standing wave ratio (VSWR) in the microstrip dual band antenna according to the present invention.

FIG. 7 is a graph illustrating a relationship between a frequency and a VSWR in the microstrip dual band antenna 10 according to the present invention. As can be readily seen from FIG. 7, in an operating frequency band of the ISM, maximum VSWRs of 1:1.6923~1.7793 and 1:1.3860~1.7623 are obtained with a resonance impedance of 50Ω.

That is to say, when assuming that 1 is an ideal VSWR value in the microstrip dual band antenna 10, in the Marker 1 included in the ISM band, a VSWR of 1.7793 is obtained at a frequency of 2.40000 GHz, and in the Marker 2, a VSWR of 1.6923 is obtained at a frequency of 2.48350 GHz. Further, in the Marker 3, a VSWR of 1.7623 is obtained at a frequency of 5.15000 GHz, and in the Marker 4, a VSWR of 1.3860 is obtained at a frequency of 5.82500 GHz. As a consequence, it is to be readily understood that excellent VSWRs are obtained in the ISM band with respect to the resonance impedance of 50Ω.

Figure 8:
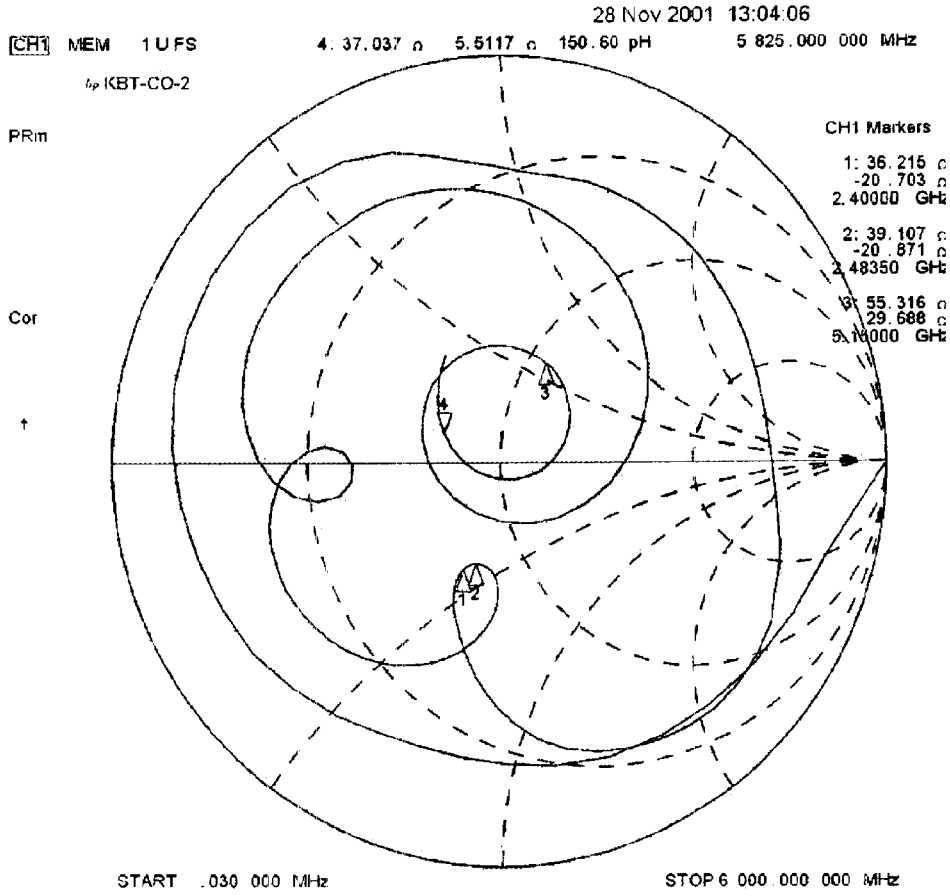
FIG. 8 is a Smith chart explaining the microstrip dual band antenna according to the present invention.

FIG. 8 is a Smith chart explaining the microstrip dual band antenna 10 according to the present invention.

As shown in FIG. 8, when the resonance impedance of 50 Ω is taken as a reference in the ISM frequency band, in the Marker 1, a resonance impedance of 36.215 Ω is obtained at the frequency of 2.40000 GHz, and in the Marker 2, a resonance impedance of 39.107 Ω is obtained at the frequency of 2.48350 GHz. Also, in the Marker 3, a resonance impedance of 55.316 Ω is obtained at the frequency of 5.15000 GHz, and in the Marker 4, a resonance impedance of 37.037 Ω is obtained at the frequency of 5.82500 GHz. As a result, in the ISM band, entire resonance impedances of 36.215~39.107 Ω and 37.037~55.316 Ω are realized. Therefore, the present antenna 10 can reliably operate in the dual band situation.

Figure 9:
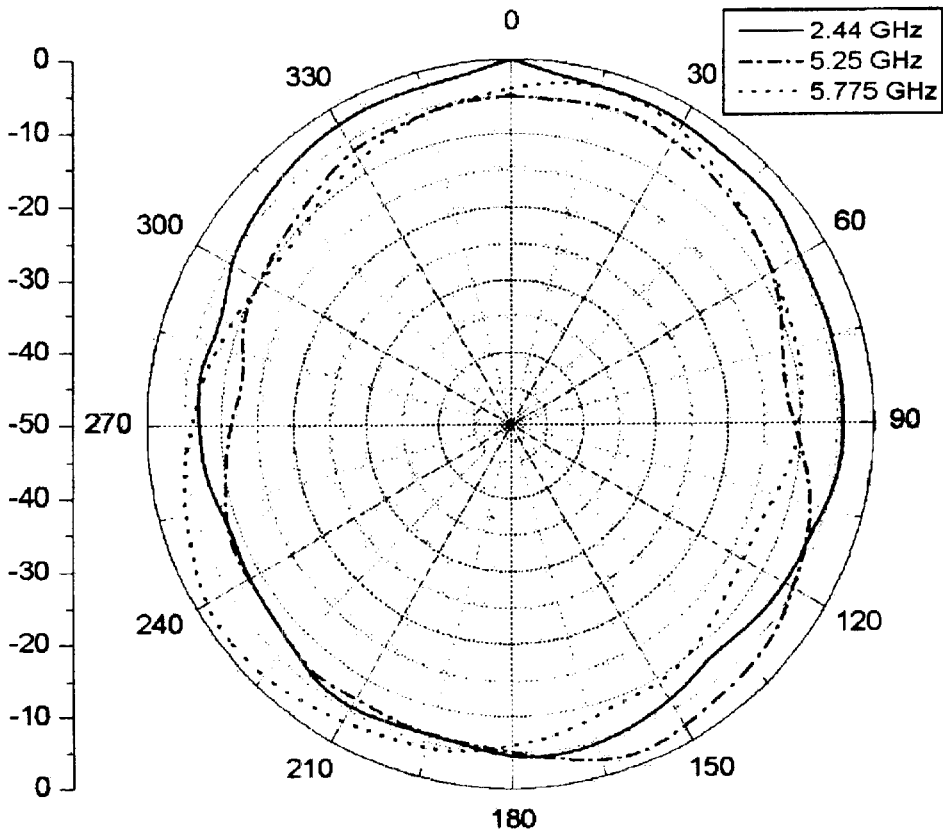
FIG. 9 is a chart explaining a radiation pattern of the microstrip dual band antenna according to the present invention.

FIG. 9 is a chart explaining a radiation pattern of the microstrip dual band antenna 10 according to the present invention. In FIG. 9, when measured in an anechoic chamber, the radiation pattern is realized as an omnidirectional radiation pattern. Hence, transmission and receipt of signals can be implemented irrespective of a position, whereby a direction-related problem can be effectively solved. At this time, measurement for the microstrip dual band antenna 10 according to the present invention is executed in an anechoic chamber having no electrical obstacle or in a field having no obstacle within 50 m in each of forward and rearward directions. In this regard, in the present invention, measurement was executed in the anechoic chamber. By measuring radiation patterns on a main electric field surface and a main magnetic field surface of each Marker point, it was found that radiation patterns on the main electric field surface and main magnetic field surface at each measuring frequency reveal omnidirectional characteristics. Therefore, the microstrip dual band antenna according to the present invention can be suitably used as an antenna for transmission and receipt of signals in the ISM band.

As apparent from the above description, the microstrip dual band antenna according to the present invention can achieve a return loss no greater than −10 dB in the ISM band. Sufficient VSWRs of 1:1.6923~1.7793 and 1:1.3860~1.7623 are obtained in an operating frequency band of the ISM. Resonance impedances of 36.215~39.107 Ω and 37.037~55.316 Ω are obtained in the ISM band. A radiation pattern is effected in all directions. Also, since a cable passage is defined in consideration of limitation in a size of a printed circuit board, so that a feeder cable can be received in the cable passage and connected to a feeder hole, the microstrip dual band antenna according to the present invention can be easily applied to operate in the ISM band.

In particular, the microstrip dual band antenna according to the present invention provides advantages in that, because a dual band can be realized, leakage current is decreased to obtain a high gain and a VSWR is improved, the microstrip dual band antenna can be installed on various radio communication equipment in a miniaturized state.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A microstrip dual band antenna comprising:

a feeder hole defined in a widthwise middle portion adjacent to one end of a dielectric body which is formed in the shape of a quadrangular prism;

a radiation patch line formed on an upper surface and on a portion of a lower surface of the dielectric body, in a manner such that it is placed around the feeder hole, extends through a first predetermined distance toward the other end of the dielectric body while having a first width corresponding to a diameter of the feeder hole, and extends through a second predetermined distance while surrounding the other end of the dielectric body and having a second width corresponding to a width of the dielectric body;

a ground line formed on the lower surface of the dielectric body to be separated from the radiation patch line, in a manner such that it extends toward one end of the dielectric body while having the second width corresponding to the width of the dielectric body;

a pair of strip lines formed on the lower surface of the dielectric body in a manner such that each of them substantially defines an L-shaped configuration and extends from a position separated from the feeder hole toward the other end of the dielectric body; and a pair of connection holes defined in the dielectric body at both sides of the feeder hole, respectively, and plated with suitable material.

2. The microstrip dual band antenna as set forth in claim 1, further comprising:

a cable passage defined in the dielectric body to extend from the feeder hole to one end of the dielectric body, so that a feeder cable can be received in the cable passage.

* * * * *